US010563328B2

(12) United States Patent
Martin et al.

(10) Patent No.: US 10,563,328 B2
(45) Date of Patent: Feb. 18, 2020

(54) FIRE RETARDANT MATTRESS CORE CAP AND METHOD OF MAKING SAME

(71) Applicant: Precision Textiles LLC, Totowa, NJ (US)

(72) Inventors: Christopher Keith Martin, Wayne, NJ (US); Peter Longo, Saddle River, NJ (US)

(73) Assignee: Precision Textiles, LLC, Totowa, NJ (US)

( * ) Notice: Subject to any disclaimer, the term of this patent is extended or adjusted under 35 U.S.C. 154(b) by 0 days.

(21) Appl. No.: 16/299,752

(22) Filed: Mar. 12, 2019

(65) Prior Publication Data

US 2019/0284737 A1 Sep. 19, 2019

Related U.S. Application Data

(60) Provisional application No. 62/642,448, filed on Mar. 13, 2018.

(51) Int. Cl.
*D04B 21/16* (2006.01)
*A47C 31/00* (2006.01)

(52) U.S. Cl.
CPC ..... *D04B 21/165* (2013.01); *A47C 31/001* (2013.01); *D10B 2201/22* (2013.01); *D10B 2331/021* (2013.01); *D10B 2331/10* (2013.01); *D10B 2401/04* (2013.01); *D10B 2503/06* (2013.01)

(58) Field of Classification Search
CPC ..... B29C 65/62; D04H 1/45
See application file for complete search history.

(56) References Cited

U.S. PATENT DOCUMENTS

2005/0118912 A1* 6/2005 Tsiarkezos ..... B32B 5/26 442/164
2005/0245164 A1* 11/2005 Aneja ..... A47C 27/12 442/414
2005/0282018 A1* 12/2005 Van Den Bergen ..... B32B 17/10706 428/426
2007/0251276 A1* 11/2007 D'Ottaviano ..... D04B 1/18 66/171
2008/0085651 A1* 4/2008 Handermann ..... D04H 5/02 442/404
2012/0102657 A1* 5/2012 Wildeman ..... A47C 27/002 5/698

* cited by examiner

*Primary Examiner* — Jeremy R Pierce
(74) *Attorney, Agent, or Firm* — Greenberg Traurig, LLP

(57) ABSTRACT

A fabric made by the method of providing a non-woven batt having flame retardant fibers, stitch bonding the non-woven batt with an elastic yarn, and heat setting the stitch bonded, non-woven batt. The stich bonded non-woven batt is exposed to a temperature in a range of 65° C. to 200° C. for a period in a range of 30 seconds to 120 seconds. In an embodiment, the fabric is adapted for use as a mattress core cover

18 Claims, 6 Drawing Sheets

FIRE RETARDANT MATTRESS CORE CAP AND METHOD OF MAKING SAME

CROSS-REFERENCE TO RELATED APPLICATION

This application is a § 111(a) application that relates to and claims the benefit of and priority to co-pending U.S. Provisional Patent Application Ser. No. 62/642,448, filed Mar. 13, 2018, entitled FIRE RETARDANT MATTRESS CORE CAP, the disclosure of which is incorporated by reference herein in its entirety.

FIELD OF THE INVENTION

The present invention relates to flame retardant fabrics used in bedding and sleep products, such as mattresses, and, more specifically, to stretchable and resilient, thermally-insulating and flame retardant covers and caps for mattress cores.

BACKGROUND OF THE INVENTION

Each year, thousands of residential fires are caused in the United States by the ignition of mattresses and bedding, resulting in hundreds of deaths and hundreds of millions of dollars in property losses. Heightened awareness of fire prevention has led to the development of standards and regulations directed to reducing the likelihood that such fires will occur. One approach to reducing the likelihood of residential fires is to use flame resistant fabrics as flame barriers in mattresses and bedding.

SUMMARY OF THE INVENTION

In an embodiment, a method for making a fabric, comprising the steps of providing a non-woven batt having flame retardant fibers; stitch bonding the non-woven batt with an elastic yarn; and heat setting the stitch bonded, non-woven batt by exposing the stich bonded non-woven batt to a temperature in a range of 65° C. to 200° C. for a time period in a range of 30 seconds to 120 seconds. In an embodiment, the flame retardant fibers include flame retardant rayon. In an embodiment, the flame retardant fibers include polyaramids. In an embodiment, the flame retardant fibers are a blend of inherently flame retardant cellulosic fibers and polyaramid fibers. In an embodiment, the blend of inherently flame retardant cellulosic fibers and polyaramid fibers are in a range of 1% to 30% by weight of the total weight of the non-woven batt. In an embodiment, the flame retardant fibers include polyester fibers. In an embodiment, the polyester fibers are in a range of 1% to 20% of the total weight of the non-woven batt. In an embodiment, the flame retardant fibers include modacrylic fibers. In an embodiment, the modacrylic fibers are in a range of 1% to 50% of the total weight of the non-woven batt.

In an embodiment, the density of the flame retardant fibers of the non-woven batt is in a range of 1.5 denier to 7 denier. In an embodiment, the non-woven batt is from 60% to 90% by weight of a total weight of the fabric. In an embodiment, the elastic yarn includes polyurethane. In an embodiment, a density of the elastic yarn is in a range of 75 denier to 300 denier. In an embodiment, the elastic yarn is from 10% to 40% by weight of the total weight of the fabric. In an embodiment, the step of stitch bonding the non-woven batt includes creating stitches with the elastic yarn, and wherein the spacing of the stiches is in a range from 10 yarns/inch to 28 yarns/inch. In an embodiment, the weight of the fabric is in a range of 50 grams per square meter (gsm) to 400 grams per square meter (gsm). In an embodiment, the method further includes the step of coating the heat set, stitch bonded, non-woven fabric with a coating. In an embodiment, the coating includes a nanoclay.

In an embodiment, a fabric made by providing a non-woven batt having flame retardant fibers; stitch bonding the non-woven batt with an elastic yarn; and heat setting the stitch bonded, non-woven batt by exposing the stich bonded non-woven fabric to a temperature in a range of 65° C. to 200° C. for a time period in a range of 30 seconds to 120 seconds. In an embodiment, the fabric is adapted for use as a mattress core cover.

In exemplary embodiments, a heat-set flame retardant, thermally-insulating non-woven fabric comprises a non-woven batt which is stitch-bonded with an elastic yarn comprising an elastane or a combination of an elastane and a polyester, wherein the fabric is stretchable and resilient. In some embodiments, the heat-set flame retardant, thermally-insulating non-woven fabric has a machine direction (MD) and a cross-direction (CD), and the fabric is stretchable in both the machine direction (MD) and in the cross-direction (CD). In some embodiments, the heat-set flame retardant, thermally-insulating non-woven fabric has been subjected to a heat setting process during which the elastic yarn contracts such that the fabric contracts in both the machine direction (MD) and in the cross-direction (CD) compared to prior to the heat setting process. In some embodiments, the elastic yarn consists of an elastane or a combination of an elastane and a polyester.

In some embodiments, the non-woven batt comprises flame retardant fibers. Suitable flame retardant fibers are made of flame retardant rayon, polyaramids (e.g., NOMEX® or KEVLAR®), elastanes (e.g., SPANDEX®, LYCRA®), flame retardant polyesters, and combinations thereof. Flame retardant rayon includes inherently flame retardant cellulosic fibers, such as rayon with incorporated silica, and cellulosic fibers with incorporated flame retardant chemicals (e.g., phosphorous compounds). In some embodiments, the non-woven batt consists of flame retardant rayon fibers.

In an embodiment, a mattress core cap according to the present invention includes the aforesaid flame retardant, thermally-insulating non-woven fabric that is stretchable and resilient. In an embodiment, a mattress core cap according to the present invention is pre-formed to fit closely to the top, sides, and corners of a mattress core. In an embodiment, a mattress core cap according to the present invention is pre-formed to be applied to the top of a mattress core and pulled downward along the sides and corners of the mattress core, the mattress core cap having an elastic piping along its edges to retain the mattress core cap around the mattress core. In an embodiment, the fabric of the mattress core cap according to the present invention stretches to conform to the shape of the foam core as the core is compressed and relaxes in response to the sleeper's movements.

BRIEF DESCRIPTION OF THE DRAWINGS

For a more complete understanding of the present invention, reference is made to the following detailed description of exemplary embodiments considered in conjunction with the accompanying drawings, which are presented for the purpose of illustration rather than being drawn to scale, and in which.

DETAILED DESCRIPTION OF THE DRAWINGS

Figure 1:
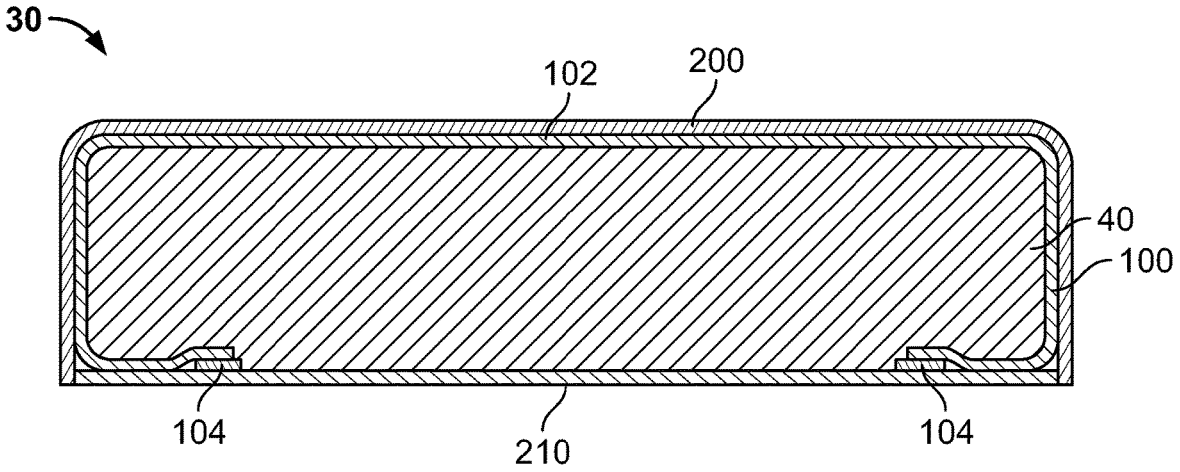
FIG. 1 is a cross-sectional view of a mattress including a mattress core cap covering a mattress core according to an embodiment.

In an embodiment, a mattress core cap according to the present invention includes a heat-set flame retardant, thermally-insulating non-woven fabric that is stretchable and resilient. In an embodiment, the non-woven fabric does not include fiberglass or other components that fragment to form irritating or toxic particles.

In an embodiment, the heat-set flame retardant, thermally-insulating non-woven fabrics include a non-woven batt which contains flame retardant fibers and is stitch-bonded with an elastic yarn. Examples of suitable flame retardant fibers include, without limitation, flame retardant rayon, polyaramids (e.g., NOMEX® or KEVLAR®), elastanes (e.g., polyurethane, SPANDEX®, LYCRA®) flame retardant polyesters, and combinations thereof. As used herein, "flame retardant rayon" includes inherently flame retardant cellulosic fibers such as, without limitation, rayon with incorporated silica, and cellulosic fibers with incorporated flame thermally-retardant chemicals (e.g., phosphorous compounds). In some embodiments, the non-woven batt consists of flame retardant rayon fibers. In some embodiments, the non-woven batt comprises a combination of flame retardant rayon fibers and fibers made of one or more of polyaramids (e.g., NOMEX® or KEVLAR®), elastanes (e.g., polyurethane, SPANDEX®, LYCRA®), and flame retardant polyesters.

In an embodiment, the heat-set flame retardant, thermally-insulating non-woven fabric is stitch-bonded with yarn made of one or more elastic materials (e.g., polyurethanes or other elastanes, including for example without limitation, SPANDEX®, or LYCRA®, such as LYCRA® T400), or a combination of one or more such elastic materials and a polyester. In an embodiment, the heat-set flame retardant, thermally-insulating non-woven fabric includes crimped or textured fibers or yarns, such that the fibers are stretchable even if the fiber material is not elastic.

In other embodiments of the heat-set flame retardant, thermally-insulating non-woven fabric, 100% by weight of the fibers in the non-woven batt are inherently flame retardant cellulosic fibers. In some exemplary embodiments, at least 40% by weight of the fibers in the non-woven batt are flame retardant rayon fibers, based on the total weight of the non-woven batt, with the remainder being other flame retardant fibers and/or non-flame retardant fibers. In other exemplary embodiments, the non-woven batt is a blend of inherently flame retardant cellulosic fibers with other flame retardant and/or non-flame retardant fibers. Exemplary blends include inherently flame retardant cellulosic fibers with one or more of the following fiber types: polyaramids, polyesters, polyurethanes or other elastanes, acrylics, modacrylics, non-flame retardant cellulosic fibers (e.g., cotton or bamboo), wool, cashmere, or silk. Further exemplary blends include inherently flame retardant cellulosic fibers and one or more of polyaramid fibers in the range of 0% to 30% of the total weight of the fibers, polyester fibers in the range of 0% to 20% of the total weight of the fibers, and modacrylic fibers in the range of 0% to 50% of the total weight of the fibers. In an embodiment, the blend of flame retardant cellulosic fibers and one or more of polyaramid fibers are in the range of 5% to 30% of the total weight of the fibers. In an embodiment, the blend of flame retardant cellulosic fibers and one or more of polyaramid fibers are in the range of 5% to 25% of the total weight of the fibers. In an embodiment, the blend of flame retardant cellulosic fibers and one or more of polyaramid fibers are in the range of 5% to 20% of the total weight of the fibers. In an embodiment, the blend of flame retardant cellulosic fibers and one or more of polyaramid fibers are in the range of 5% to 15% of the total weight of the fibers. In an embodiment, the blend of flame retardant cellulosic fibers and one or more of polyaramid fibers are in the range of 5% to 10% of the total weight of the fibers. In an embodiment, the blend of flame retardant cellulosic fibers and one or more of polyaramid fibers is 5% of the total weight of the fibers. In an embodiment, the blend of flame retardant cellulosic fibers and one or more of polyaramid fibers is 10% of the total weight of the fibers. In an embodiment, the blend of flame retardant cellulosic fibers and one or more of polyaramid fibers is 15% of the total weight of the fibers. In an embodiment, the blend of flame retardant cellulosic fibers and one or more of polyaramid fibers is 20% of the total weight of the fibers. In an embodiment, the blend of flame retardant cellulosic fibers and one or more of polyaramid fibers is 25% of the total weight of the fibers. In an embodiment, the blend of flame retardant cellulosic fibers and one or more of polyaramid fibers is 30% of the total weight of the fibers. In an embodiment, the polyester fibers in the range of 0% to 20% of the total weight of the fibers. In an embodiment, the polyester fibers in the range of 5% to 20% of the total weight of the fibers. In an embodiment, the polyester fibers in the range of 10% to 20% of the total weight of the fibers. In an embodiment, the polyester fibers in the range of 15% to 20% of the total weight of the fibers. In an embodiment, the polyester fibers in the range of 5% to 15% of the total weight of the fibers. In an embodiment, the polyester fibers in the range of 5% to 10% of the total weight of the fibers. In an embodiment, the polyester fibers in the range of 10% to 15% of the total weight of the fibers. In an embodiment, the modacrylic fibers in the range of 0% to 50% of the total weight of the fibers. In an embodiment, the modacrylic fibers in the range of 5% to 50% of the total weight of the fibers. In an embodiment, the modacrylic fibers in the range of 10% to 50% of the total weight of the fibers. In an embodiment, the modacrylic fibers in the range of 15% to 50% of the total weight of the fibers. In an embodiment, the modacrylic fibers in the range of 20% to 50% of the total weight of the fibers. In an embodiment, the modacrylic fibers in the range of 25% to 50% of the total weight of the fibers. In an embodiment, the modacrylic fibers in the range of 30% to 50% of the total weight of the fibers. In an embodiment, the modacrylic fibers in the range of 35% to 50% of the total weight of the fibers. In an embodiment, the modacrylic fibers in the range of 40% to 50% of the total weight of the fibers. In an embodiment, the modacrylic fibers in the range of 45% to 50% of the total weight of the fibers. In an embodiment, the modacrylic fibers in the range of 10% to 40% of the total weight of the fibers. In an embodiment, the modacrylic fibers in the range of 20% to 40% of the total weight of the fibers. In an embodiment, the modacrylic fibers in the range of 30% to 40% of the total weight of the fibers. In an embodiment, the modacrylic fibers in the range of 10% to 30% of the total weight of the fibers. In an embodiment, the modacrylic fibers in the range of 20% to 30% of the total weight of the fibers.

In other embodiments of the heat-set non-woven fabric, the materials of the fibers and blends are selected such that the fabric is both stretchable and resilient. In other embodiments, the heat-set flame retardant, thermally-insulating non-woven fabric stretches in the machine direction (MD) of the fabric. In other embodiments, the heat-set flame retardant, thermally-insulating non-woven fabric stretches in both the machine direction (MD) and in the cross-direction (CD) of the fabric.

In other embodiments of the heat-set flame retardant, thermally-insulating non-woven fabric, the density of the fibers of the non-woven batt is in the range of from 1.5 denier to 7 denier. In an embodiment, the density of the fibers of the non-woven batt is in the range of from 1.5 denier to 6 denier. In an embodiment, the density of the fibers of the non-woven batt is in the range of from 1.5 denier to 5 denier. In an embodiment, the density of the fibers of the non-woven batt is in the range of from 1.5 denier to 4 denier. In an embodiment, the density of the fibers of the non-woven batt is in the range of from 1.5 denier to 3 denier. In an embodiment, the density of the fibers of the non-woven batt is in the range of from 3.5 to 5.5 denier. In an embodiment, the density of the fibers of the non-woven batt is in the range of from 4 to 5 denier.

In an embodiment, the non-woven batt is from 60% to 90% by weight of the total weight of the fabric. In an embodiment, the non-woven batt is from 70% to 90% by weight of the total weight of the fabric. In an embodiment, the non-woven batt is from 80% to 90% by weight of the total weight of the fabric. In an embodiment, the non-woven batt is from 60% to 80% by weight of the total weight of the fabric. In an embodiment, the non-woven batt is from 60% to 70% by weight of the total weight of the fabric. In an embodiment, the non-woven batt is from 75% to 85% by weight of the total weight of the fabric. In an embodiment, the non-woven batt is 80% by weight of the total weight of the fabric. In an embodiment, the non-woven batt is 70% by weight of the total weight of the fabric. In an embodiment, the non-woven batt is 60% by weight of the total weight of the fabric. In an embodiment, the non-woven batt is 90% by weight of the total weight of the fabric.

In an embodiment, the heat-set flame retardant, thermally-insulating non-woven fabric does not include any binders or binding materials, such as thermoplastics or latexes. In exemplary embodiments of the heat-set flame retardant, thermally-insulating non-woven fabric, the density of the yarn used for stitch-bonding the non-woven batt is in the range of from 75 denier to 300 denier. In an embodiment, the density of the yarn used for stitch-bonding the non-woven batt is in the range of from 75 denier to 250 denier. In an embodiment, the density of the yarn used for stitch-bonding the non-woven batt is in the range of from 75 denier to 200 denier. In an embodiment, the density of the yarn used for stitch-bonding the non-woven batt is in the range of from 75 denier to 150 denier. In an embodiment, the density of the yarn used for stitch-bonding the non-woven batt is in the range of from 75 denier to 100 denier. In an embodiment, the density of the yarn used for stitch-bonding the non-woven batt is in the range of from 100 denier to 300 denier. In an embodiment, the density of the yarn used for stitch-bonding the non-woven batt is in the range of from 150 denier to 300 denier. In an embodiment, the density of the yarn used for stitch-bonding the non-woven batt is in the range of from 200 denier to 300 denier. In an embodiment, the density of the yarn used for stitch-bonding the non-woven batt is in the range of from 250 denier to 300 denier. In an embodiment, the density of the yarn used for stitch-bonding the non-woven batt is in the range of from 100 denier to 200 denier. In an embodiment, the density of the yarn used for stitch-bonding the non-woven batt is in the range of from 150 denier to 200 denier. In an embodiment, the density of the yarn used for stitch-bonding the non-woven batt is 75 denier. In an embodiment, the density of the yarn used for stitch-bonding the non-woven batt is 100 denier. In an embodiment, the density of the yarn used for stitch-bonding the non-woven batt is 150 denier. In an embodiment, the density of the yarn used for stitch-bonding the non-woven batt is 200 denier. In an embodiment, the density of the yarn used for stitch-bonding the non-woven batt is 250 denier. In an embodiment, the density of the yarn used for stitch-bonding the non-woven batt is 300 denier.

In other embodiments of the fabric, the yarn is from 10% to 40% by weight of the total weight of the fabric. In an embodiment, the yarn is from 10% to 30% by weight of the total weight of the fabric. In an embodiment, the yarn is from 10% to 20% by weight of the total weight of the fabric. In an embodiment, the yarn is from 10% by weight of the total weight of the fabric. In an embodiment, the yarn is 20% by weight of the total weight of the fabric. In an embodiment, the yarn is 30% by weight of the total weight of the fabric.

In other embodiments, the spacing of the stitches in the stitch-bonded heat-set flame retardant, thermally-insulating non-woven fabric is in the range of from 10 yarns/inch to 28 yarns/inch. In an embodiment, the spacing of the stitches in the stitch-bonded heat-set flame retardant, thermally-insulating non-woven fabric is in the range of from 15 yarns/inch to 28 yarns/inch. In an embodiment, the spacing of the stitches in the stitch-bonded heat-set flame retardant, thermally-insulating non-woven fabric is in the range of from 20 yarns/inch to 28 yarns/inch. In an embodiment, the spacing of the stitches in the stitch-bonded heat-set flame retardant, thermally-insulating non-woven fabric is in the range of from 15 yarns/inch to 20 yarns/inch. In an embodiment, the spacing of the stitches in the stitch-bonded heat-set flame retardant, thermally-insulating non-woven fabric is in the range of from 15 yarns/inch to 21 yarns/inch. In an embodiment, the spacing of the stitches in the stitch-bonded heat-set flame retardant, thermally-insulating non-woven fabric is 15 yarns/inch. In an embodiment, the spacing of the stitches in the stitch-bonded heat-set flame retardant, thermally-insulating non-woven fabric is 18 yarns/inch. In an embodiment, the spacing of the stitches in the stitch-bonded heat-set flame retardant, thermally-insulating non-woven fabric is 21 yarns/inch. In an embodiment, the spacing of the stitches in the stitch-bonded heat-set flame retardant, thermally-insulating non-woven fabric is 28 yarns/inch.

In other embodiments of the stitch-bonded heat-set flame retardant, thermally-insulating non-woven fabric, the weight of the fabric is in the range of 50 gsm to 400 grams per square meter (gsm). In an embodiment, the weight of the fabric is in the range of 100 gsm to 400 grams per square meter (gsm). In an embodiment, the weight of the fabric is in the range of 200 gsm to 400 grams per square meter (gsm). In an embodiment, the weight of the fabric is in the range of 300 gsm to 400 grams per square meter (gsm). In an embodiment, the weight of the fabric is in the range of 100 gsm to 300 grams per square meter (gsm). In an embodiment, the weight of the fabric is in the range of 100 gsm to 200 grams per square meter (gsm). In an embodiment, the weight of the fabric is in the range of 175 gsm to 225 grams per square meter (gsm). In an embodiment, the weight of the fabric is 100 gsm. In an embodiment, the weight of the fabric is 150 gsm. In an embodiment, the weight of the fabric is 175 gsm. In an embodiment, the weight of the fabric is 200 gsm. In an embodiment, the weight of the fabric is 225 gsm. In an embodiment, the weight of the fabric is 300 gsm. In an embodiment, the weight of the fabric is 400 gsm.

In some embodiments of the stitch-bonded heat-set flame retardant, thermally-insulating non-woven fabric, the non-woven batt is at least 40% by weight of the total weight of the fabric, and the yarn is no more than 60% by weight of the total weight of the fabric. In some embodiments, the non-woven batt is from about 70% to 80% by weight of the total weight of the fabric, and the yarn used to stitch-bond the fabric is from about 20% to 30% by weight of the total weight of the fabric. In an embodiment, the non-woven batt is from about 40% by weight of the total weight of the fabric, and the yarn used to stitch-bond the fabric is from about 60% by weight of the total weight of the fabric. In an embodiment, the non-woven batt is from about 50% by weight of the total weight of the fabric, and the yarn used to stitch-bond the fabric is from about 50% by weight of the total weight of the fabric. In an embodiment, the non-woven batt is from about 60% by weight of the total weight of the fabric, and the yarn used to stitch-bond the fabric is from about 40% by weight of the total weight of the fabric. In an embodiment, the non-woven batt is from about 70% by weight of the total weight of the fabric, and the yarn used to stitch-bond the fabric is from about 30% by weight of the total weight of the fabric. In an embodiment, the non-woven batt is from about 80% by weight of the total weight of the fabric, and the yarn used to stitch-bond the fabric is from about 20% by weight of the total weight of the fabric.

In an exemplary embodiment of the stitch-bonded heat-set flame retardant, thermally-insulating non-woven fabric, the fabric is a coated non-woven fabric (not shown), wherein the coating is applied to the fabric. In an exemplary embodiment of the coated non-woven fabric, the coating includes one or more flame retardant chemicals. In an exemplary embodiment of the coated non-woven fabric, the coating includes a nanoclay. In an exemplary embodiment of the coated non-woven fabric, the coating includes graphite. In an exemplary embodiment of the present invention, the non-woven fabric does not have a coating.

In exemplary embodiments of the stitch-bonded heat-set flame retardant, thermally-insulating non-woven fabric, the non-woven batt is made of one or more of the same fibers discussed above with respect to the non-woven fabric and the yarn is made of flame retardant material such as described above. In exemplary embodiments, only the non-woven batt includes fibers that are flame retardant. In exemplary embodiments, the flame retardant fibers in the non-woven batt render the entire stitch-bonded heat-set flame retardant, thermally-insulating non-woven fabric flame retardant.

In an exemplary embodiment, the non-woven batt includes inherently flame retardant viscose fibers. In an exemplary embodiment, all of the fibers in the non-woven batt are flame retardant viscose fibers. In an embodiment, the non-woven batt includes a blend of fibers made from different materials. In an exemplary embodiment, the yarn of the stitch-bonded heat-set flame retardant, thermally-insulating non-woven fabric shrink when heated to a critical temperature which depends on the particular elastic material from which the yarn is made. In an exemplary embodiment, the fibers of the non-woven batt include fibers that shrink when heated to a critical temperature specific to the material of the fiber. In an exemplary embodiment, the fibers of the non-woven batt consist of fibers that shrink when heated to a critical temperature specific to the material of the fiber.

In an embodiment, the fibers in the non-woven batt include fibers of different denier. In an embodiment, the fibers in the non-woven batt consist of fibers of approximately the same denier.

Subsequent to the stitch-bonding of the non-woven batt with the elastic yarn, the flame retardant, thermally-insulating non-woven fabric is subjected to a heat setting process. The setting temperature and duration of the heat setting process are such that the stitch-bonded heat-set flame retardant, thermally-insulating non-woven fabric shrinks in both the machine direction (MD) and cross-direction (CD) relative to the non-woven batt. For example, during a typical heat setting process, the flame retardant, thermally-insulating non-woven fabric would be subjected to a temperature of from 65° C. to 200° C., for a time period of from 30 seconds to 120 seconds. The setting temperatures and duration of the heat setting process are selected based on the material of the elastic yarn used to stitch bond the non-woven batt to elastically shrink, or contract, the yarn. An unexpected result of subjecting the stitch-bonded flame retardant, thermally-insulating non-woven fabric to heat setting is that the entire fabric becomes elastic, i.e., stretchable and resilient. In other words, after heat setting, the non-woven batt and yarn stitches stretch together in both the machine direction and cross direction without distortion or separation. Moreover, the heat-set flame retardant, thermally-insulating non-woven fabric is resilient such that after such stretching, the fabric returns substantially to its contracted state (pre-stretched size and dimensions). This stretching and relaxing of the stitch-bonded heat-set flame retardant, thermally-insulating non-woven fabric is repeatable multiple times.

In an exemplary embodiment, the stitch-bonded heat-set flame retardant, thermally-insulating non-woven fabric has a weight of about 200 gsm, and consists of about 160 gsm of the non-woven batt which includes 100% flame retardant rayon fibers, and about 40 gsm of elastic yarn stitch bonding which includes 100% LYCRA® T400. Such an embodiment of fabric would be, for example, subjected to heat setting as a temperature of from 65 to 200° C., for a time period of from 30 seconds to 120 seconds.

FIG. 1 is a cross-sectional view of a foam core mattress 30 made of the above-described heat-set flame retardant, thermally-insulating non-woven fabric according to an embodiment of the present invention. Referring to FIG. 1, the foam core mattress 30 includes a foam core 40, a mattress core cap 100, a ticking 200 over the cap 100, and a filler cloth 210 that completes the enclosure of the cap 100 and core 40. In an exemplary embodiment, the mattress core cap 100 includes a non-woven or knitted thermally-insulating, flame retardant fabric 102 such as those discussed above, and an elastic piping 104 sewn to the fabric 102. In an exemplary embodiment, the mattress 30 does not include a filler cloth 210. In an exemplary embodiment, the mattress 30 does not include a filler cloth 210 or a mattress ticking 200.

In known methods of fabricating a cover for a foam core mattress, a sheet of flame retardant fabric is fashioned into a tube or sock, and pulled over the foam core. The open ends of the tube or the open end of the sock are then sewn so that the fabric encloses the foam core. This method of applying the fabric to the foam core is labor-intensive and time-consuming because friction between the fabric and the surface of the foam core cause the fabric to resist being pulled across the surface of the core. A mattress core cap according to embodiments of the present invention allows the fabric to be quickly and easily applied to the foam core. An exemplary embodiment 100 of such a mattress core cap is described below.

Figure 2:
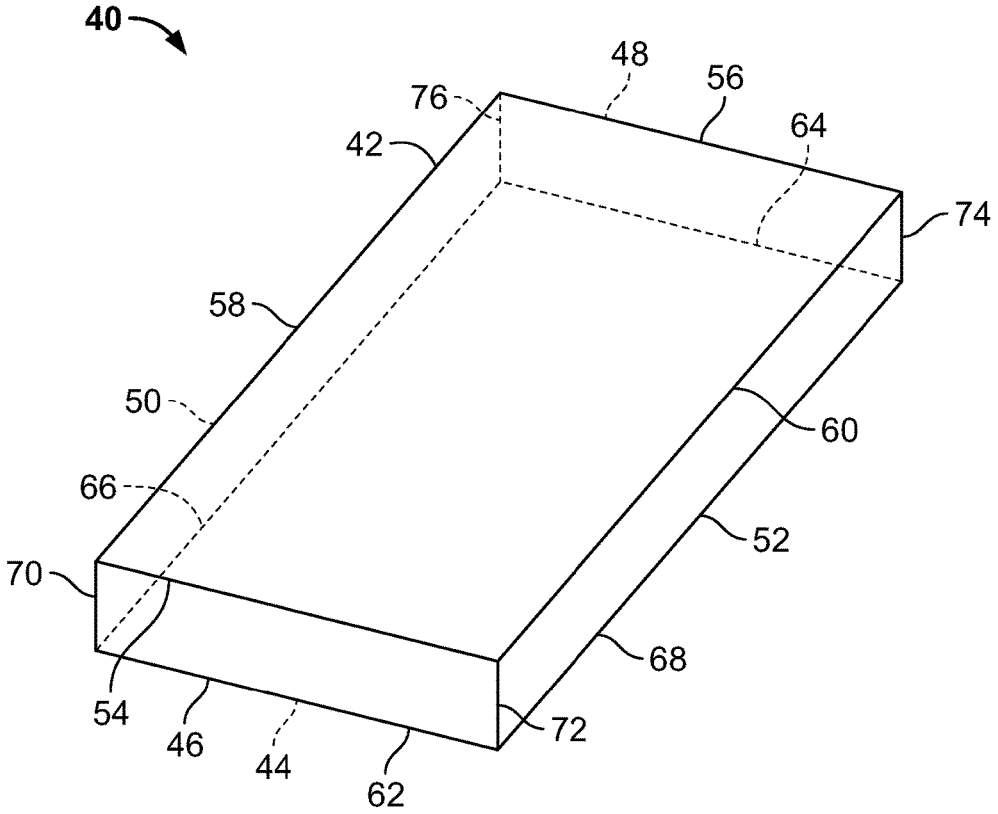
FIG. 2 is a schematic orthogonal view of the mattress core of FIG. 1, with hidden edges of the mattress core shown in dashed lines.

FIG. 2 is a schematic orthogonal view of the mattress core 40 of FIG. 1, where hidden edges of the mattress core 40 are indicated by dashed lines. In the embodiment of FIG. 2, the mattress core 40 has a shape approximating that of a rectangular prism, although the mattress cores of other embodiments may have other shapes. In an embodiment, the mattress core 40 is made of or includes a resilient foam. In an embodiment, the resilient foam is a polyurethane foam. In an embodiment, the resilient foam is a latex foam. In an embodiment, the resilient foam is a foam that conforms to the shape of a person lying on the mattress, and rebounds to its original shape when the weight of the person is removed from the mattress.

In an embodiment, the mattress core 40 has a top ("sleeping") surface 42, a bottom surface 44 opposite the top surface 42, a first end face 46, a second end face 48 opposite the first end face 46, a first side face 50, and a second side face 52 opposite the first side face 50. The top surface 42 is bounded by a first end edge 54, a second end edge 56 opposite the first end edge 54, a first side edge 58 extending from the first end edge 54 to the second end edge 56, and a second side edge 60 opposite the first side edge 58 and extending from the first end edge 54 to the second end edge 56. The bottom surface 44 is bounded by a third end edge 62 opposite the first end edge 54, a fourth end edge 64 opposite the second end edge 56, a third side edge 66 extending from the third end edge 62 to the fourth end edge 64, and a fourth side edge 68 opposite the third side edge 66 and extending from the third end edge 62 to the fourth end edge 64. The first end face 46 is bounded by the first end edge 54, the third end edge 62, a first corner edge 70 extending from the first end edge 54 to the third end edge 62, and a second corner edge 72 opposite the first corner edge 70 and extending from the first end edge 54 to the third end edge 62. The second end face 48 is bounded by the second end edge 56, the fourth end edge 64, a third corner edge 74 extending from the second end edge 56 to the fourth end edge 64, and a fourth corner edge 76 opposite the third corner edge 76 and extending from the second end edge 56 to the fourth end edge 64. The first side face 50 is bounded by the first side edge 58, the third side edge 66, the first corner edge 70, and the fourth corner edge 76. The second side face 52 is bounded by the second side edge 60, the fourth side edge 68, the second corner edge 72, and the third corner edge 74.

Figure 3:
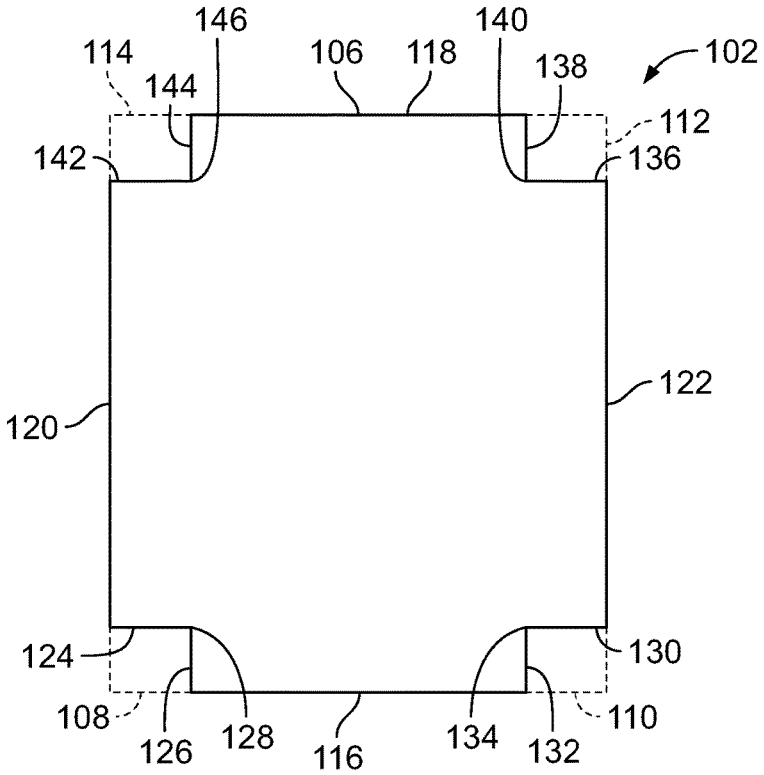
FIG. 3 is a schematic top view of a sheet of fabric that is adapted to be shaped into the mattress core cap of FIG. 1 to cover the mattress core of FIG. 2.

FIG. 3 is a schematic top view of the sheet of fabric 102 before it is shaped to form the mattress core cap 100. With reference to FIG. 3, in the illustrated embodiment, the sheet of fabric 102 is provided as a rectangular sheet 106, and four corner pieces 108, 110, 112, 114, indicated by dashed lines, are cut away from the rectangular sheet 102 as part of the shaping of the mattress cover 100.

The rectangular sheet 106 of fabric 102 has a first edge 116, a second edge 118 opposite the first edge 116, a third edge 120 extending from the first edge 116 to the second edge 118, and a fourth edge 122 opposite the third edge 120 and extending from the first edge 116 to the second edge 118. The four corner pieces 108, 110, 112, 114 of the rectangular sheet 106 are cut away, leaving intersecting edges on the sheet 106 of fabric 102, as are described further herein. Cutting away corner piece 108 produces intersecting edges 124, 126, which intersect at point 128; cutting away corner piece 110 produces intersecting edges 130, 132, which intersect at point 134; cutting away corner piece 112 produces intersecting edges 136, 138, which intersect at point 140; and cutting away corner piece 114 produces intersecting edges 142, 144, which intersect at point 146. The lengths of the various intersecting edges referenced above are such that, if the sheet 106 were draped over the top surface 42 of the mattress core 40, the edges 116, 118, 120, 122 of the sheet 106 would extend beyond the bottom surface 44 of the mattress core 40 by a distance. In an embodiment, the distance is in the range of about 2 inches to about 8 inches (i.e., the edges 116, 118, 120, 122 would be from 2-8 inches longer than the length of the corner edges 70, 72, 74, 76 of the mattress core 40).

Figure 4:
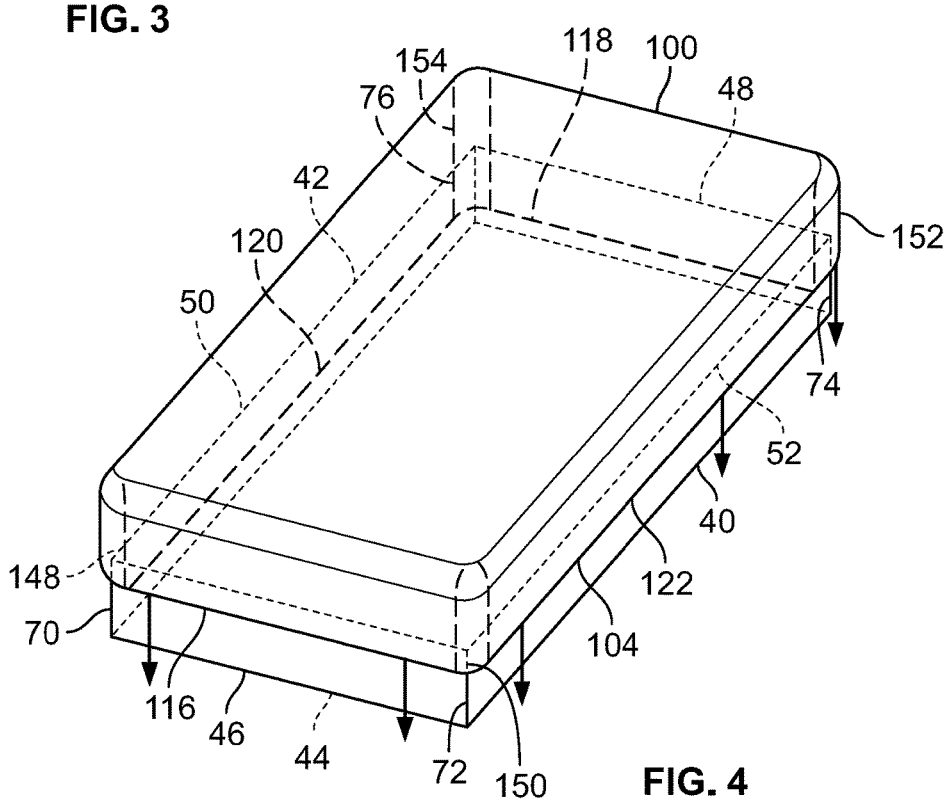
FIG. 4 is a schematic orthogonal view of the mattress core cap of FIG. 1 during a step of fitting the mattress core cap over the foam mattress core of FIG. 1, with hidden edges of the mattress core shown in dashed lines.
Figure 5:
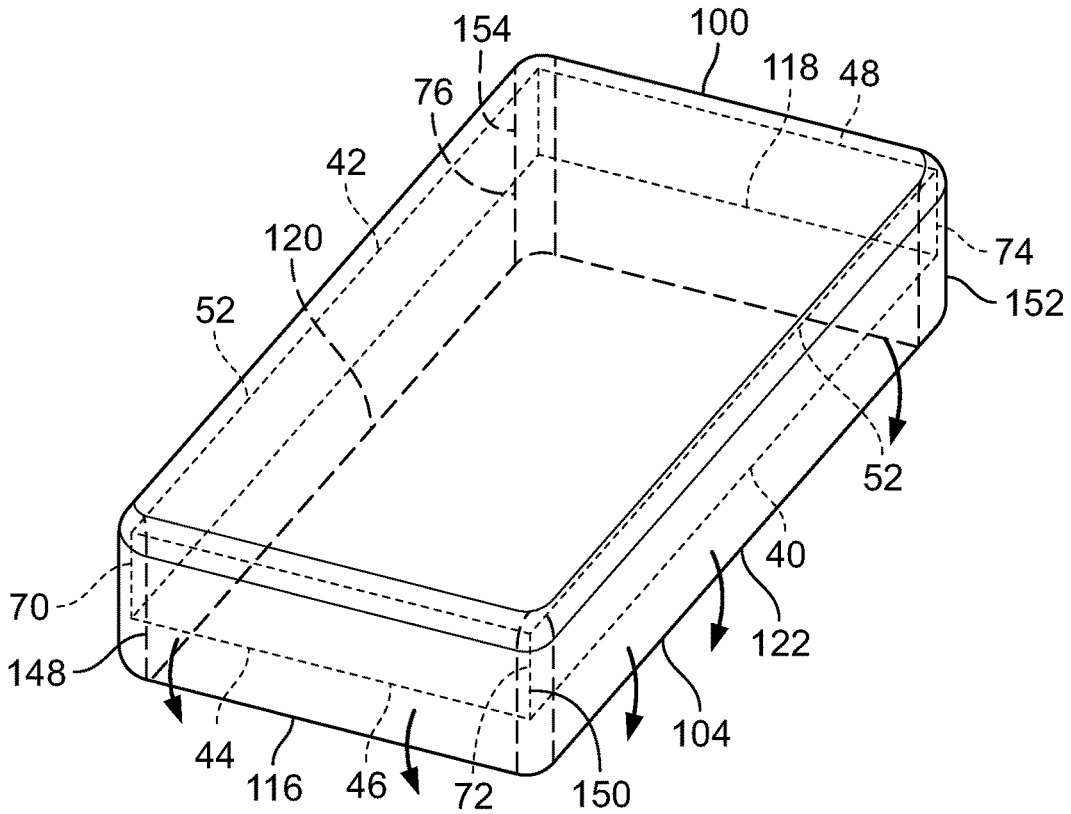
FIG. 5 is a schematic orthogonal view of the mattress core cap of FIG. 1 illustrating the mechanism of fitting the mattress core cap over the foam mattress core of FIG. 1, with hidden edges of the mattress core shown in dashed lines.

Referring to FIGS. 3-5, in the shaping process, edge 124 is drawn to edge 126, and the edges 124, 126 are sewn to each other to create a first corner seam 148; edge 130 is drawn to edge 132, and the edges 130, 132 are sewn to each other to create a second corner seam 150; edge 136 is drawn to edge 138, and the edges 136, 138 are sewn to teach other to create a third corner seam 152; and edge 142 is drawn to edge 144, and the edges 142, 144 are sewn together to create a fourth corner seam 154. The corner seams 148, 150, 152, 154 are not shown in FIG. 5, but are shown in FIGS. 4-7. In an exemplary embodiment, the various intersecting edges referenced above are sewn as described above using a flame retardant yarn or filament (not shown). In an embodiment, the yarn or filament includes one or more of the flame retardant materials or blends described above with respect to the exemplary non-woven fabrics and knitted fabrics. In an embodiment, the yarn or filament includes a polyaramid.

Referring to FIGS. 1 and 4-7, in an exemplary embodiment of the present invention, a continuous length of elastic piping 104 is sewn along the first edge 116, second edge 118, third edge 120, and fourth edge 122 of the sheet 106, subsequent to the creation of the corner seams 148, 150, 152, 154. In an exemplary embodiment, the piping 104 is sewn to form a closed loop of piping 104 (see FIGS. 4-7). In an exemplary embodiment, the piping is arranged to draw the first edge 116, second edge 118, third edge 120, and fourth edge 122 of the sheet 106 toward each other (see FIG. 7), yet is sufficiently elastic that it can be stretched to a circumference that allows the mattress cover cap 100 to be drawn over the top surface 42 of the mattress core 40 (see FIGS. 4-5). In an exemplary embodiment, the piping 104 is sewn to the sheet 106 of fabric 102 using a flame retardant yarn or filament (not shown). In an exemplary embodiment, the yarn or filament includes one or more of the flame retardant materials or blends described above with respect to the exemplary non-woven fabrics and knitted fabrics. In an exemplary embodiment, the yarn or filament includes a polyaramid.

FIG. 4 is a schematic orthogonal view of the exemplary mattress core cap 100 during a step of fitting the mattress core cap 100 over the foam mattress core 40 of FIG. 2. FIG. 5 is a schematic orthogonal view of the mattress core cap 100 of FIG. 4, illustrating a further step of fitting the mattress core cap over the foam mattress core 40, subsequent to the step illustrated in FIG. 2.

Figure 6:
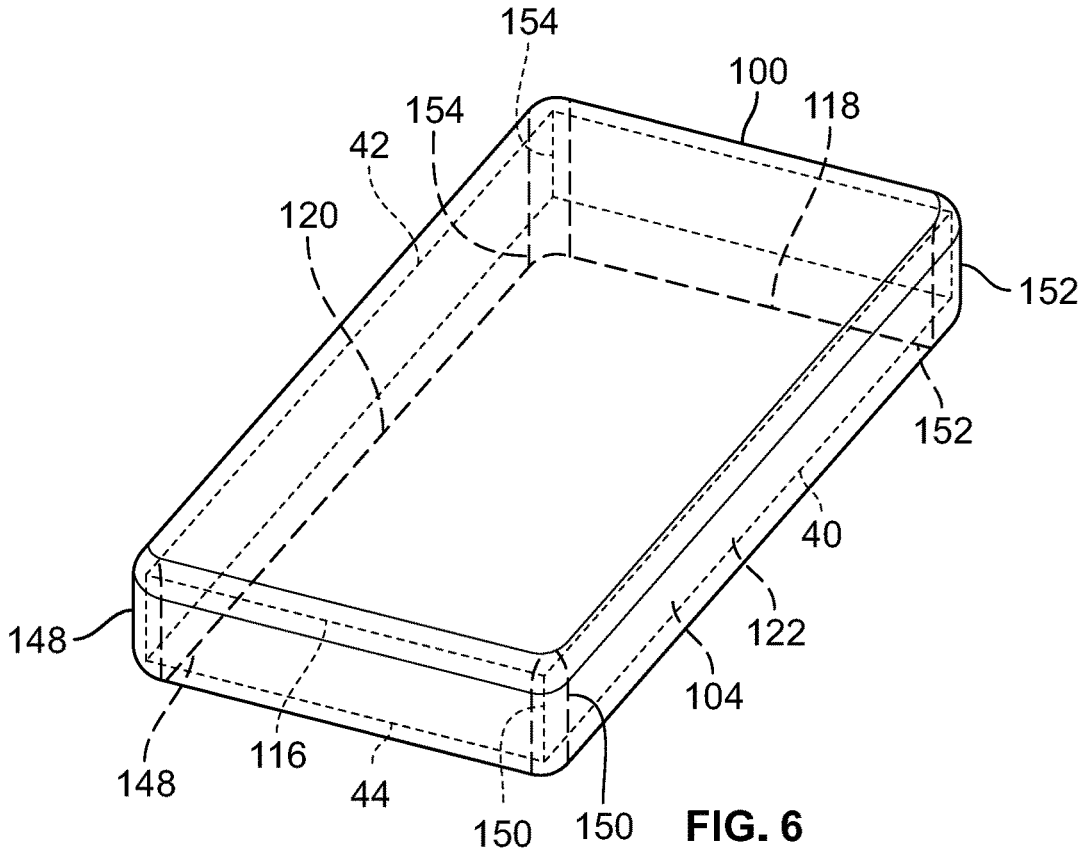
FIG. 6 is a schematic orthogonal view of the mattress core cap of FIG. 1 fitted to the mattress core of FIG. 1, with hidden edges of the mattress core and hidden features of the mattress core cap shown in dashed lines.
Figure 7:
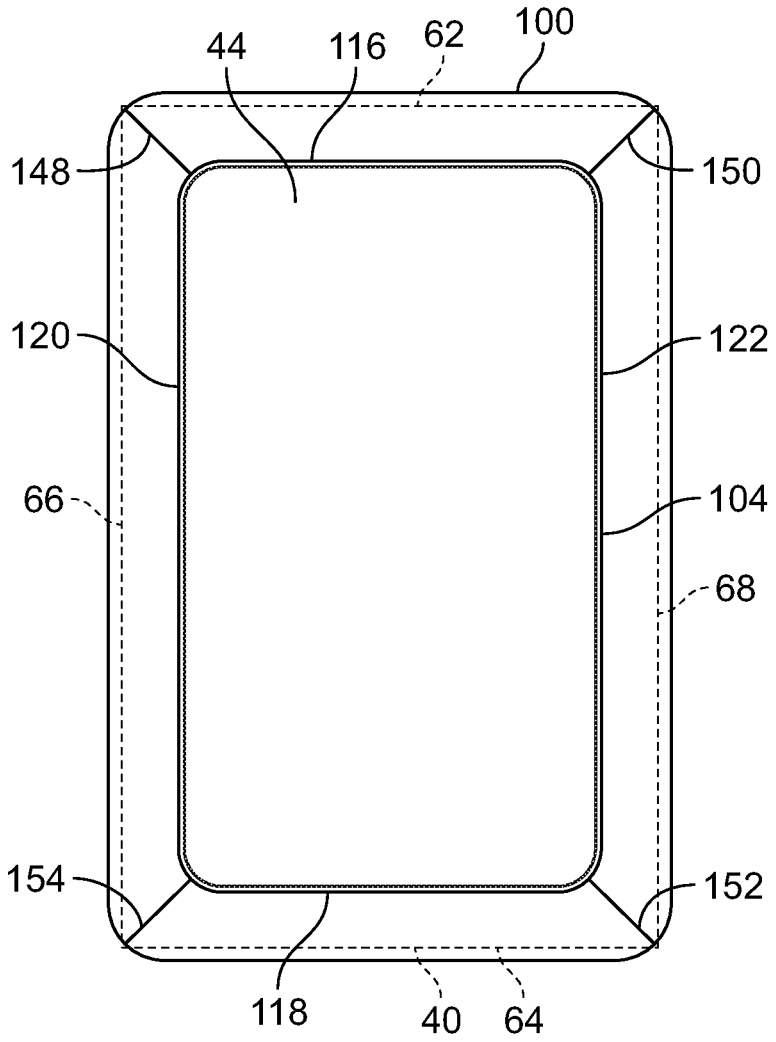
FIG. 7 is a schematic bottom view of the mattress core and the mattress core cap of FIG. 6.

Referring to FIGS. 4 and 5, the exemplary mattress core cap 100 is applied to the top 42 of the mattress core 40 by approaching the mattress core 40 from above and stretching the piping 104 over the top surface 42, first end face 46, second end face 48, first side face 50, and second side face 52 of the mattress core 40. The first seam 148, second seam 150, third seam 152, and fourth seam 154 are roughly aligned respectively with the first corner edge 70, the second corner edge 72, the third corner edge 74, and the fourth corner edge 76 of the mattress core 40. Referring to FIG. 7, the piping 104 is then pulled below the bottom surface 44 of the mattress core 40. The resilience of the piping 104 causes it to contract and pull the first edge 116, second edge 118, third edge 120, and fourth edge 122 toward each other (FIGS. 6-7). As a result of the contraction of the piping 104, the mattress core cap 100 is pulled into a close fit with all of the faces 42, 44, 46, 48, 50, 52 of the mattress core 40. FIG. 6 is a schematic orthogonal view of the mattress core cap 100 of FIG. 4 fitted to the mattress core 40. The piping 104 proximate to the bottom surface 44 of the mattress core 40 is shown in dashed lines.

FIG. 7 is a schematic bottom view of the mattress core cap 100 fitted to the mattress core 40. FIG. 7 shows the bottom surface 44 of the mattress core 40, the mattress core cap 100 tucked against the bottom surface 44 of the mattress core 40, the first, second, third, and fourth seams 148, 150, 152, 154, and the piping of the mattress core cap 104, all in relation to the third and fourth side edges 66, 68 and third and fourth end edges 62, 64 of the mattress core 40.

The foregoing discussion of FIGS. 1-5 relates to an exemplary embodiment of the mattress core cap 100 that is adapted to a mattress core 40 that approximates the shape of a rectangular prism. The exemplary thermally-insulating, flame retardant fabrics discussed above can be cut and sewn to cover cores having a broad range of shapes that are known in the art, in manners that will be understood by those having ordinary skill in the art. Thus, the exemplary mattress core cap 100 can be readily adapted to provide flame resistance in cushions, pillows, mattresses, and various resilient accessories that decorate or add functionality to household furnishings. Further, the foregoing discussion of FIGS. 1-5 relates to embodiments of the mattress core cap 100 that are fitted directly to a foam mattress core 40. The inventive concepts disclosed herein can readily be adapted to provide mattress core caps that cover other types of cores, or that cover mattresses, pillows, cushions, and so forth, that are otherwise complete or partially complete. The mattress core cap of the present invention may also be used in situations where there are foam or fabric layers, or other materials, between the core and mattress core cap.

Figure 8:
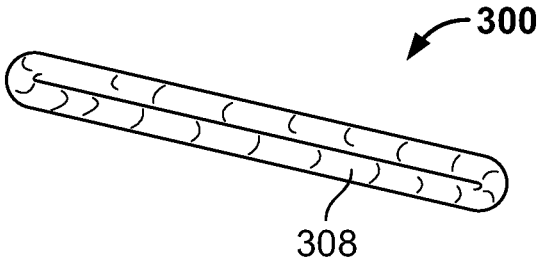
FIG. 8 is a schematic perspective view of a flame retardant, thermally-insulating fabric barrier comprising a sheet of heat-set flame retardant, thermally-insulating non-woven fabric shaped into a sleeve and in its pre-installation rolled configuration.
Figure 9:
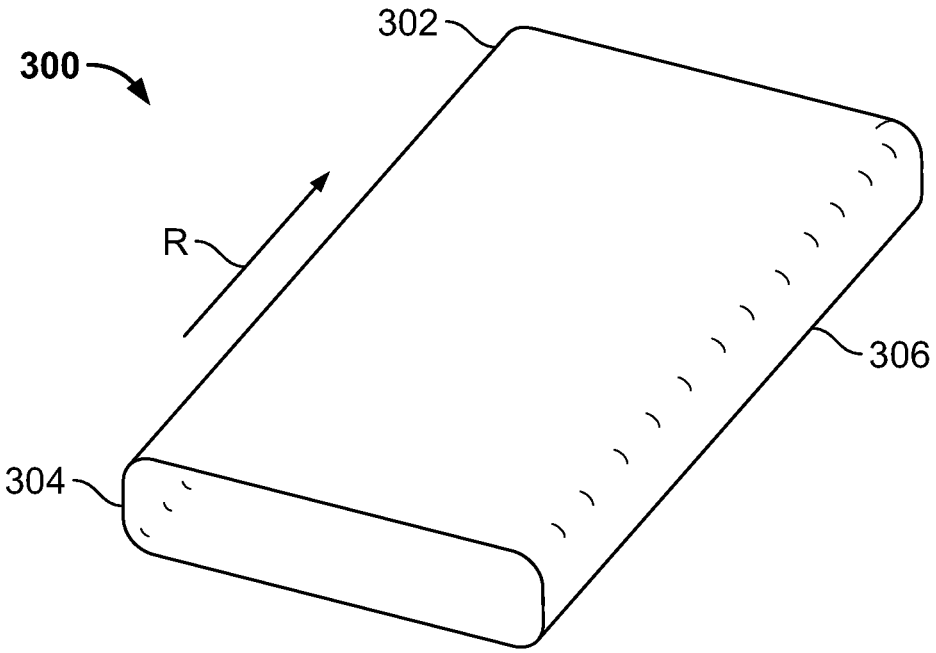
FIG. 9 is a schematic perspective view of the flame retardant, thermally-insulating fabric barrier of FIG. 8 in its unrolled configuration.
Figure 10:
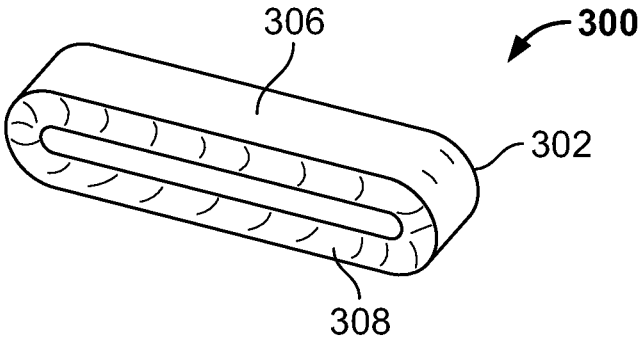
FIG. 10 is a schematic perspective view of the flame retardant, thermally-insulating fabric barrier of FIG. 8 in its partially rolled/unrolled configuration.

As described above, previously known covers for foam core mattress which are shaped into a tube or sock and pulled over a foam mattress core have drawbacks, including difficulty caused by resistance of the fabric to being pulled across the surface of the mattress core due to friction between the fabric and the surface of the mattress core. With reference to FIGS. 8-10, in another embodiment of the invention described herein, a flame retardant, thermally-insulating fabric barrier 300, which is more easily installed onto a mattress core than the aforesaid tube or sock, is shown in its pre-installation rolled configuration (FIG. 8), its unrolled configuration (FIG. 9) and its partially rolled/unrolled configuration (FIG. 10). The flame retardant, thermally-insulating fabric barrier 300 is generally sized and shaped to fit closely and snugly with a mattress core 40, such as that shown in FIG. 2.

Figure 11:
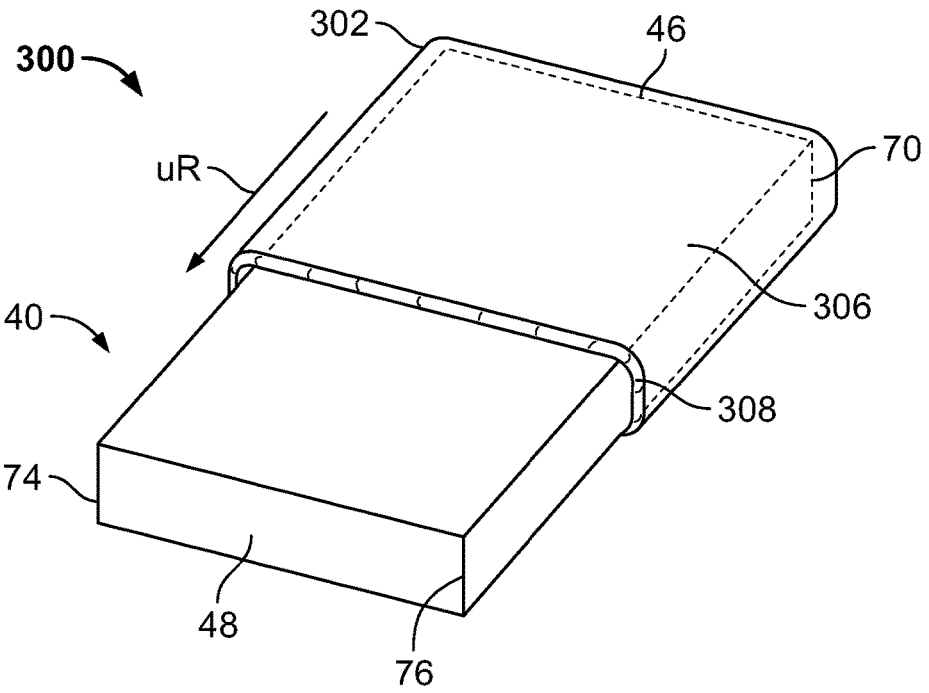
FIG. 11 is a schematic perspective view of the flame retardant, thermally-insulating fabric barrier of FIG. 8 being installed on the mattress core and in its partially unrolled configuration.

The flame retardant, thermally-insulating fabric barrier 300 comprises a sheet of flame retardant, thermally-insulating fabric which may comprise non-woven, knitted, or composite flame retardant, thermally-insulating fabric as described hereinabove and, as seen most clearly in the unrolled configuration of the fabric barrier 300 shown in FIG. 9, is shaped into tube or sleeve having a starting end 302 which is open or closed, an open opposite end 304, and a sleeve wall 306 extending between the starting and opposite ends 302, 304. To form the pre-installation rolled configuration of the fabric barrier 300 shown in FIG. 8, the sleeve wall 306 is rolled onto itself, beginning at the opposite end 304 (i.e., in the direction of the arrow R in FIG. 9) until the entire sleeve wall 306 forms a sleeve ring 308 adjacent the starting end 302 and the fabric barrier 300. This pre-installation rolled configuration of the fabric barrier 300 is the form in which the fabric barrier 300 would be provided prior to installation on the mattress core 40. FIG. 11 shows a partially rolled/unrolled configuration of the fabric barrier 300 (FIG. 10) wherein the starting end 302 is visible and a portion of the sleeve wall 306 has been unrolled from the sleeve ring 308.

Figure 12:
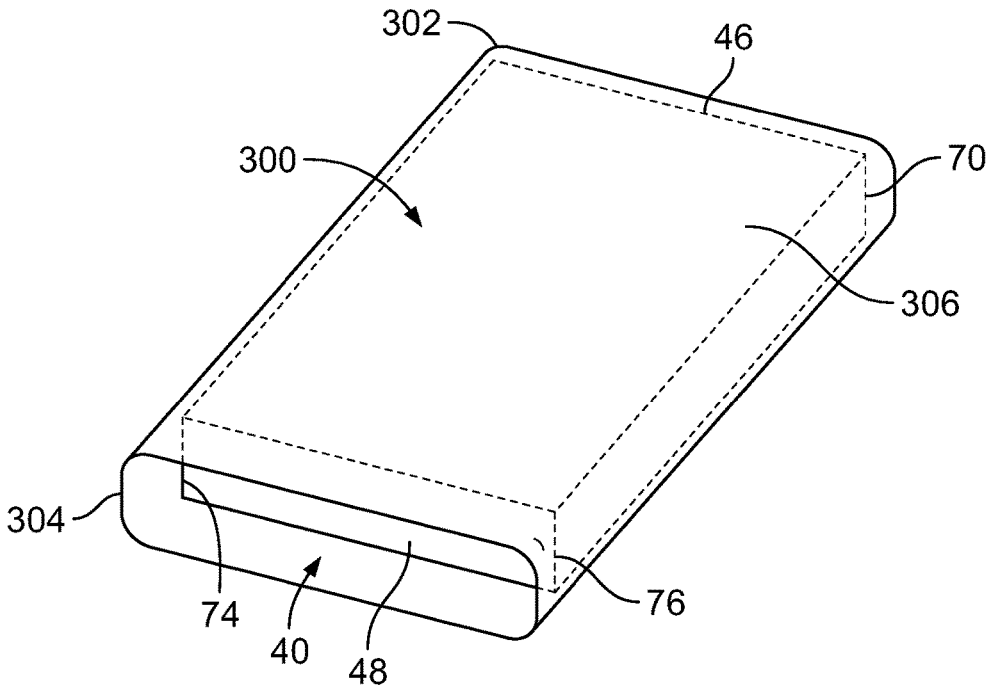
FIG. 12 is a schematic perspective view of the flame retardant, thermally-insulating fabric barrier of FIG. 11 being installed on the mattress core and in its unrolled configuration.

With reference to FIGS. 11 and 12, to install the fabric barrier 300, the starting end 302 with the sleeve ring 308 adjacent thereto is positioned in alignment with the first end face 46 and the first and second corner edges 70, 72 of the mattress core 40 (see FIG. 11). Next, the sleeve ring 308 is unrolled along the top, bottom, and first and second side faces of the mattress core 40 (i.e., in the direction of the arrow UR in FIG. 11). As will be readily understood by persons of ordinary skill in the art, the sleeve ring 308 is unrolled until, as shown in FIG. 12, the entire sleeve wall 306 is unrolled and lies against the respective surfaces of the mattress core 40, and the opposite end 304 of the fabric barrier 300 extends beyond the second end face 48 of the mattress core 40. The opposite end 304 of the fabric barrier 300 may be closed by gluing, sewing, fastening or otherwise affixing the opposite end 304 over the second end face 48 of the mattress core 40 (not shown).

To avoid overstretching of the fabric barrier 300 while still facilitating a close, snug fit between the mattress core 40 and the fabric barrier 300, the fabric barrier 300 may include one or more pre-sewn fitted sheet style corner seams (not shown, but similar to the corner seams 148, 150, 152, 154 of the mattress core cap 100 of the previously described embodiment shown in FIGS. 4-7). For example, in some embodiments (not shown), the flame retardant, thermally-insulating fabric barrier includes four such pre-sewn fitted sheet style corner seams proximate to the starting end, each of pair of which is oriented and sized to receive a respective one of the first and second corner edges 70, 72 of the mattress core 40 (see, e.g., FIG. 2), and another four such pre-sewn fitted sheet style corner seams proximate to the opposite end and oriented and sized to receive the third and fourth corner edges 74, 76 of a mattress core 40 (see FIG. 2).

In some embodiments, the heat-set flame-retardant, thermally-insulating non-woven fabric described above may be laminated with another fabric, which may or may not also be flame retardant, to provide a flame-retardant, thermally-insulating layered composite fabric which is suitable for producing a mattress core cap 100 (FIGS. 1-7), or other configurations of flame retardant fire barriers for mattress cores. The heat-set flame retardant, thermally-insulating non-woven fabric may be laminated, sealed, or affixed with another fabric using heat treatments, stitching techniques, adhesives, or other techniques known to persons of ordinary skill in the relevant art now and in the future to permanently attach fabric layers together. For example, in some embodiments, the heat-set flame retardant, thermally-insulating non-woven fabric described above is laminated with a knit fabric which is not flame retardant and does not include flame retardant chemicals. In some embodiments, the heat-set flame retardant thermally-insulating non-woven fabric described above is laminated with a woven fabric which is not flame retardant and does not include flame retardant chemicals. For example, the heat-set flame retardant, thermally-insulating non-woven fabric may be laminated to ticking fabric and the resulting flame retardant, thermally-insulating layered composite fabric used to cover a mattress core as the ticking (see, e.g., ticking 200 in FIG. 1). In some embodiments, the above-described heat-set flame retardant, thermally-insulating non-woven fabric may be provided as a continuous rolled sheet to enable or facilitate the aforesaid lamination of the composite fabric to another fabric.

It should be understood that the embodiments described herein are merely exemplary in nature and that a person skilled in the art may make many variations and modifications thereto without departing from the scope of the present invention. All such variations and modifications, including those discussed above, are intended to be included within the scope of the claims.

What is claimed is:

1. A method for making a fabric, comprising the steps of:
providing a non-woven batt having flame retardant fibers;
stitch bonding the non-woven batt with an elastic yarn;
heat treating the stitch bonded, non-woven batt and contracting the elastic yarn and the non-woven batt by exposing the stich bonded non-woven batt to a temperature in a range of 160° C. to 200° C. for a time period in a range of 30 seconds to 120 seconds.

2. The method of claim 1, wherein the flame retardant fibers include flame retardant rayon.

3. The method of claim 1, wherein the flame retardant fibers include polyaramids.

4. The method of claim 3, wherein the flame retardant fibers are a blend of inherently flame retardant cellulosic fibers and polyaramid fibers.

5. The method of claim 4, wherein the blend of inherently flame retardant cellulosic fibers and polyaramid fibers are in a range of 1% to 30% by weight of the total weight of the non-woven batt.

6. The method of claim 4, wherein the flame retardant fibers include polyester fibers.

7. The method of claim 6, wherein the polyester fibers are in a range of 1% to 20% of the total weight of the non-woven batt.

8. The method of claim 6, wherein the flame retardant fibers include modacrylic fibers.

9. The method of claim 8, wherein the modacrylic fibers are in a range of 1% to 50% of the total weight of the non-woven batt.

10. The method of claim 1, wherein the density of the flame retardant fibers of the non-woven batt is in a range of 1.5 denier to 7 denier.

11. The method of claim 1, wherein the non-woven batt is from 60% to 90% by weight of a total weight of the fabric.

12. The method of claim 1, wherein the elastic yarn includes filament polyester.

13. The method of claim 1, wherein a density of the elastic yarn is in a range of 75 denier to 300 denier.

14. The method of claim 11, wherein the elastic yarn is from 10% to 40% by weight of the total weight of the fabric.

15. The method of claim 1, wherein the step of stitch bonding the non-woven batt includes creating stitches with the elastic yarn, and wherein the spacing of the stiches is in a range from 10 yarns/inch to 28 yarns/inch.

16. The method of claim 1, wherein the weight of the fabric is in a range of 50 grams per square meter (gsm) to 400 grams per square meter (gsm).

17. The method of claim 1, further comprising the step of coating the heat set, stitch bonded, non-woven fabric with a coating.

18. The method of claim 17, wherein the coating includes a nanoclay.

* * * * *